US011777231B2

(12) United States Patent
Zimmerman

(10) Patent No.: US 11,777,231 B2
(45) Date of Patent: Oct. 3, 2023

(54) BASE STATION ANTENNAS HAVING SPARSE AND/OR INTERLEAVED MULTI-COLUMN ARRAYS

(71) Applicant: CommScope Technologies LLC, Hickory, NC (US)

(72) Inventor: Martin L. Zimmerman, Chicago, IL (US)

(73) Assignee: CommScope Technologies LLC, Hickory, NC (US)

( * ) Notice: Subject to any disclaimer, the term of this patent is extended or adjusted under 35 U.S.C. 154(b) by 146 days.

(21) Appl. No.: 17/525,208

(22) Filed: Nov. 12, 2021

(65) Prior Publication Data

US 2022/0158362 A1 May 19, 2022

Related U.S. Application Data

(60) Provisional application No. 63/115,930, filed on Nov. 19, 2020.

(51) Int. Cl.

| | |
|---|---|
| ***H01Q 1/24*** | (2006.01) |
| ***H01Q 21/28*** | (2006.01) |
| ***H01Q 3/34*** | (2006.01) |
| ***H01Q 21/26*** | (2006.01) |
| *H01Q 1/36* | (2006.01) |
| *H01Q 9/04* | (2006.01) |

(52) U.S. Cl.

CPC ..... *H01Q 21/28* (2013.01); *H01Q 1/246* (2013.01); *H01Q 3/34* (2013.01); *H01Q 21/26* (2013.01); *H01Q 1/36* (2013.01); *H01Q 9/0421* (2013.01)

(58) Field of Classification Search

CPC ..... H01Q 21/28; H01Q 1/246; H01Q 3/34; H01Q 21/26; H01Q 9/0421; H01Q 1/36

See application file for complete search history.

(56) References Cited

U.S. PATENT DOCUMENTS

| | | | | |
|---|---|---|---|---|
| 2002/0140616 | A1 | 10/2002 | Kanamaluru | |
| 2012/0223852 | A1 | 9/2012 | Gross et al. | |
| 2017/0229785 | A1 | 8/2017 | Fu et al. | |
| 2023/0092210 | A1* | 3/2023 | Yang ..... | H01Q 1/421 343/702 |

OTHER PUBLICATIONS

"European Search Report corresponding to European Application No. 21208826.4, dated Apr. 20, 2022, 10 pages".

* cited by examiner

*Primary Examiner* — Joseph J Lauture
(74) *Attorney, Agent, or Firm* — Myers Bigel, P.A.

(57) ABSTRACT

Base station antennas include a first array that has a plurality of columns of radiating elements. All of the columns in the first array except for a first column and a second column are spaced apart from adjacent of the columns of the first array by a first distance. The first and second columns of the first array are spaced apart from each other a second, larger distance (e.g., twice the first distance) to define a first column-shaped open space within the first array. A column of a second array may be positioned in the first column-shaped open space within the first array.

20 Claims, 9 Drawing Sheets

BASE STATION ANTENNAS HAVING SPARSE AND/OR INTERLEAVED MULTI-COLUMN ARRAYS

CROSS-REFERENCE TO RELATED APPLICATION

The present application claims priority under 35 U.S.C. § 119 to U.S. Provisional Patent Application Ser. No. 63/115,930, filed Nov. 19, 2020, the entire content of which is incorporated herein by reference as if set forth in its entirety.

FIELD

The present application relates to cellular communications systems and, more particularly, to base station antennas having a plurality of multi-column antenna arrays.

BACKGROUND

Supporting cellular communications in stadiums and other large venues such as concert halls, convention centers, outdoor amphitheaters and the like may be particularly challenging because large numbers of users are present in the venue during events, and hence a cellular communications system may need to support very high levels of capacity within the venue. While conventional base station antennas may be used to provide service in such venues, the antenna beams formed by conventional base station antennas typically are not well-suited to providing coverage in large venues, as venues tend to pack large numbers of users in a relatively small area with the base station antennas being located in close proximity to the users. As such, if conventional base station antennas are used to provide service in a large venue, issues such as wasted spectrum, overlapping coverage areas (and associated interference issues), and regions that exhibit poor quality of service may arise.

In order to avoid these issues, so-called "stadium" base station antennas have been proposed that generate generally rectangular radiation patterns or "antenna beams." U.S. Patent Publication NO. 2017/0229785, published Aug. 10, 2017 and titled Stadium Antenna (herein "the '785 publication"), discloses a "stadium" base station antenna that generates rectangular antenna beams. As explained in the '785 publication, rectangularly-shaped antenna beams may be particularly well-suited for providing coverage to stadiums and other large venues, particularly when the antennas are mounted above the users (e.g., on the ceiling or high on the walls of the venue) and pointed downwardly (e.g., at an elevation angle of between −25° and −165°) or pointed generally horizontally (sometimes even with an uptilt in the elevation plane) at a portion of a stadium. The stadium antenna disclosed in the '785 publication includes three multi-column arrays that generate antenna beams having half power or "3 dB" beamwidths of about 50° in both the azimuth and elevation planes so that the antenna beams have a generally square-shape.

The stadium antenna of the '785 publication may support high capacity levels because (1) the antenna generates antenna beams having narrowed beamwidths in the azimuth plane as compared to conventional base station antennas, resulting in higher antenna gains, and (2) the antenna has three multi-column antenna arrays that support service in three different frequency bands. Additionally, because the antenna arrays generate antenna beams, the antenna beams formed by a particular antenna can be configured to provide good coverage to a discrete section of the stadium or other venue while limiting the degree to which the antenna beams spills over into adjacent sections that are covered by other antennas (where the first antenna beam will appear as interference).

FIGS. 1A and 1B are a schematic perspective view and a schematic front view, respectively, of the stadium base station antenna 100 that is disclosed in the '785 publication. The stadium antenna 100 includes first through third multi-column antenna arrays 120, 130, 140 that are mounted to extend forwardly from a ground plane/reflector 110. Each multi-column antenna array 120, 130, 140 includes twenty-five radiating elements that are mounted in five columns 122-1 through 122-5 and five rows 124-1 through 124-5. Note that herein the full reference numeral (e.g., column 122-4) may be used to refer to a specific one of these like elements, while the first part of the reference numeral (e.g., the columns 122) may be used to refer to all of the like elements collectively. The first multi-column array 120 is a low-band array that includes twenty-five low-band radiating elements 126 that are configured to operate in the 790-960 MHz frequency range. The second multi-column array 130 is a lower-mid-band array that includes twenty-five lower-mid-band radiating elements 136 that are configured to operate in the 1710-2170 MHz frequency range. The third multi-column array 140 is an upper-mid-band array that includes twenty-five upper-mid-band radiating elements 146 that are configured to operate in the 2300-2690 MHz frequency range. The radiating elements 126, 136, and 146 are dual-polarized radiating elements so that each antenna array 120, 130, 140 can simultaneously generate two antenna beams at orthogonal polarizations to support 2×MIMO (multi-input-multi-output) communications. Thus, the stadium antenna 100 can simultaneously generate a total of six antenna beams (two antenna beams at each of three different frequency bands). Stadium antenna 100 may fit within a housing that is 1350 mm tall by 850 mm wide.

The far field radiation pattern of an antenna array is the Fourier transform of the near field radiation pattern. Each of the antenna arrays 120, 130, 140 of stadium antenna 100 is configured to generate radiation patterns having a generally square shape, as a square radiation pattern may be particularly well-suited to provide coverage to large venues using base station antennas that are mounted high on the walls and/or on the ceilings of the venues. The Fourier transform of a square pulse is the SINC function (sin(x)/x). Thus, arrays 120, 130, 140 of venue antenna 100 each include a respective feed network that splits RF signals that are fed to the five columns of radiating elements in the array based on a SINC function.

FIG. 1C is a schematic diagram illustrating how the power of an RF signal is divided and fed to the radiating elements 136 of lower-mid-band array 130 of stadium antenna 100 in order to generate a radiation pattern having a square shape. The same feeding mechanism is used for antenna arrays 120 and 140. As shown in FIG. 1C, a digital approximation of the SINC function may be used to feed the radiating elements 136 of array 130. In particular, the relative amplitudes of the sub-components of an RF signal that are fed to the five columns 132-1 through 132-5 of antenna array 130 are 0.4, 0.76, 0.43, 0.14, 0.22, respectively. The same digital approximation of the SINC function is used to feed the five rows 134-1 through 134-5 of array 130 (the amplitudes for the columns/rows are shown underneath the column/row number). The amplitude of the sub-components of the RF signal that are fed to each individual radiating element 136 are determined as the product of the relative amounts fed to the column and row where each radiating element 136 is positioned. The relative individual amplitudes are shown underneath each radiating element in the array 130. The relative power that is fed to an individual radiating element may be determined by taking the square of the amplitude of the sub-component that is fed to the radiating element. The relative power level of the sub-components fed to the radiating elements is shown to the right of each radiating element. The relative phases for the radiating elements are illustrated in FIG. 7 of the '785 publication.

SUMMARY

Pursuant to embodiments of the present invention, base station antennas are provided that include a first array that includes a plurality of columns of radiating elements, where all of the columns in the first array except for a first column and a second column are spaced apart from adjacent of the columns of the first array by a first distance, and the first and second columns of the first array are spaced apart from each other by a different distance that is larger than the first distance to define a first column-shaped open space within the first array.

In some embodiments, the different distance is about twice the first distance.

In some embodiments, the first column-shaped open space may not include any radiating elements that are part of the first array or may include a total of one radiating element that is part of the first array. In some embodiments, the first column-shaped open space may be directly adjacent an exterior one of the plurality of columns.

In some embodiments, the radiating elements may also be arranged in a plurality of rows, and all of the rows of the first array except for a first row and a second row of the first array may be spaced apart from adjacent of the rows of the first array by a second distance, the first and second rows of the first array being spaced apart from each other by twice the second distance to define a first row-shaped open space within the first array. In some embodiments, the first row-shaped open space may not include any radiating elements that are part of the first array or may include a total of one radiating element that is part of the first array. The first row-shaped open space may be directly adjacent an exterior one of the plurality of rows of the first array.

In some embodiments, the base station antenna may further include a second array that includes a plurality of columns of radiating elements, where all of the columns in the second array except for a first column and a second column of the second array are spaced apart from adjacent of the columns of the second array by a third distance, and the first and second columns of the second array are spaced apart from each other by twice the third distance to define a second column-shaped open space within the second array. In some embodiments, the second column-shaped open space may not include any radiating elements that are part of the second array or may include a total of one radiating element that is part of the second array. The second column-shaped open space may be directly adjacent an exterior one of the plurality of columns of the second array.

In some embodiments, the radiating elements of the second array may also be arranged in a plurality of rows, and all of the rows of the second array except for a first row and a second row of the second array are spaced apart from adjacent of the rows of the second array by a fourth distance, the first and second rows of the second array being spaced apart from each other by twice the fourth distance to define a second row-shaped open space within the second array. The second row-shaped open space may, for example, not include any radiating elements that are part of the second array or may include a total of one radiating element that is part of the second array. The second row-shaped open space may be directly adjacent an exterior one of the plurality of rows of the second array.

In some embodiments, multiple columns of radiating elements of the second array may be positioned in the column-shaped open space within the first array. In other embodiments, a single column of radiating elements of the second array may be positioned in the column-shaped open space within the first array.

In some embodiments, the first array and the second array may be stacked side-by-side, and the radiating elements of the second array may be within a footprint of the first array.

In some embodiments, the base station antenna may further include a third array that includes a plurality of columns of radiating elements. In some embodiments, all of the columns in the third array except for a first column and a second column of the third array may be spaced apart from adjacent of the columns of the third array by a fifth distance, and the first and second columns of the third array may be spaced apart from each other by twice the fifth distance to define a third column-shaped open space within the third array. The third column-shaped open space may, for example, not include any radiating elements that are part of the third array or may include a total of one radiating element that is part of the third array. The third column-shaped open space may be directly adjacent an exterior one of the plurality of columns of the third array.

In some embodiments, the radiating elements of the third array may also be arranged in a plurality of rows, and all of the rows in the third array except for a first row and a second row of the third array may be spaced apart from adjacent of the rows of the third array by a sixth distance, the first and second rows of the third array being spaced apart from each other by twice the sixth distance to define a third row-shaped open space within the third array. The third row-shaped open space may, for example, not include any radiating elements that are part of the third array or may include a total of one radiating element that is part of the third array. The third row-shaped open space may be directly adjacent an exterior one of the plurality of rows of the third array.

In some embodiments, a single column of radiating elements of the first array may be positioned in the column-shaped open space within the third array. In other embodiments, a single column of radiating elements of the second array may be positioned in the column-shaped open space within the third array.

In some embodiments, the first array may be configured to generate a substantially rectangular radiation pattern when excited by a radio frequency signal. In some embodiments, the first array may have a total of four columns and four rows of radiating elements.

In all of above-described embodiments, the radiating elements in the columns of radiating elements of the first array may be configured to be coupled to a common radio.

Pursuant to further embodiments of the present invention, base station antennas are provided that include a first array that includes a plurality of columns of radiating elements and a second array that includes a plurality of columns of radiating elements. A first column of radiating elements of the first array is within an interior of the second array, and a first column of radiating elements of the second array is within an interior of the first array.

In some embodiments, the first column of radiating elements of the first array may be directly adjacent an exterior column of radiating elements of the second array.

In some embodiments, the radiating elements of the first array may be arranged in a plurality of rows, and all of the rows in the array except for a first row and a second row of the first array are spaced apart from adjacent of the rows of the first array by a second distance, the first and second rows of the first array being spaced apart from each other by twice the second distance to define a first row-shaped open space within the first array. the first row-shaped open space may not include any radiating elements that are part of the first array. In some embodiments, the first row-shaped open space may be directly adjacent an exterior one of the plurality of rows of the first array.

In some embodiments, the radiating elements of the second array may also be arranged in a plurality of rows, and all of the rows of the second array except for a first row and a second row of the second array may be spaced apart from adjacent of the rows of the second array by a fourth distance, the first and second rows of the second array being spaced apart from each other by twice the fourth distance to define a second row-shaped open space within the second array.

In some embodiments, the base station antenna may further include a third array that includes a plurality of columns of radiating elements. The radiating elements of the third array may be arranged in a plurality of rows, and all of the rows of the third array except for a first row and a second row of the third array may be spaced apart from adjacent of the rows of the third array by a sixth distance, and the first and second rows of the third array may be spaced apart from each other by twice the sixth distance to define a third row-shaped open space within the third array. In some embodiments, a single column of radiating elements of the first array may be positioned in the row-shaped open space within the third array.

In some embodiments, both the first array and the second array may be configured to generate substantially rectangular radiation patterns when excited by radio frequency signals. In some embodiments, the first array may have a total of four columns and four rows of radiating elements and the second array has a total of four columns and four rows of radiating elements. In some embodiments, the radiating elements in the columns of radiating elements of the first array may be configured to be coupled to a common radio. In some embodiments, rows of the first array may be aligned with rows of the second array. In other embodiments, rows of the first array may be offset from rows of the second array.

Pursuant to further embodiments of the present invention, base station antennas are provided that include a first array that includes a plurality of rows of radiating elements, a second array that includes a plurality of rows of radiating elements, and a third array that includes a plurality of rows of radiating elements, where a first exterior row of the third array is spaced apart from an adjacent row of the third array by a greater distance than the spacing between any of the other adjacent rows in the third array to define a third row-shaped open space within the third array. A first row of the first array is positioned within the third row-shaped open space within the third array.

In some embodiments, a second row of the second array may also be positioned within the third row-shaped open space within the third array. In some embodiments, the first row of the first array may be aligned with the second row of the second array. In some embodiments, all of the radiating elements in the third array may be coupled to a common radio frequency port of the base station antenna. In some embodiments, the first array, the second array and the third array may each be configured to generate substantially rectangular radiation patterns when excited by radio frequency signals. In some embodiments, the first array and the second array may be configured to operate in a first operating frequency band, and the third array may be configured to operate in a second operating frequency band that does not overlap with the first operating frequency band.

DETAILED DESCRIPTION

Figure 1A:
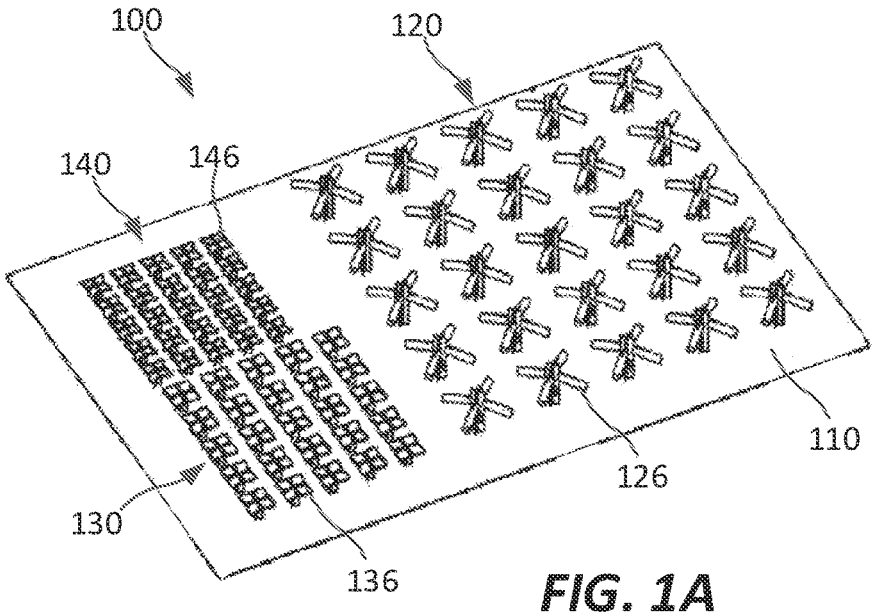
FIGS. 1A and 1B are a schematic perspective view and a schematic front view, respectively, of a conventional stadium antenna that is disclosed in the '785 publication.

Pursuant to embodiments of the present invention, base station antennas are provided that may be particularly well-suited for use in stadiums and other large venues. In some embodiments, these base station antennas may be configured to generate antenna beams that have substantially rectangular shapes (e.g., square-shaped antenna beams). A plurality of the base station antennas according to embodiments of the present invention may, for example, be mounted on the ceilings or high on the walls of large venues and used to provide a checkerboard coverage plan that provides cellular service throughout the venue. Moreover, the antenna arrays included in the base station antennas according to embodiments of the present invention may comprise "sparse" arrays that include rows and columns of radiating elements in which some or all of the radiating elements are omitted from selected of the rows and columns. The use of such sparse antenna arrays allows the radiating elements of two adjacent arrays to be interleaved with each other. This may reduce the amount of surface area on the reflector of the base station antenna required by the arrays, allowing the overall size of the base station antenna to be reduced and/or adding additional antenna arrays to the antenna without increasing the size thereof.

In some embodiments, the base station antennas may include at least one antenna array that includes a plurality of rows and columns of radiating elements, where all of the columns in the array except for adjacent first and second columns are spaced apart from adjacent columns by a first distance, and the first and second columns are spaced apart from each other by twice the first distance to define a column-shaped open space within the array. All of the rows of the array except for adjacent first and second rows may similarly be spaced apart from adjacent rows by a second distance, and the first and second rows may be spaced apart from each other by twice the second distance to define a row-shaped open space within the array. The column-shaped open space may be directly adjacent an exterior column of the array, and the row-shaped open space may be directly adjacent an exterior row of the array.

In some embodiments, the base station antenna may include at least first and second arrays that have a column-shaped open space and/or a row-shaped open space therein. In such embodiments, a column of radiating elements of the first array may be positioned within the column-shaped open space of the second array, or a row of radiating elements of the first array may be positioned within the row-shaped open space of the second array. The converse may also or additionally be true, namely that a column of radiating elements of the second array may be positioned within the column-shaped open space of the first array, or a row of radiating elements of the second array may be positioned within the row-shaped open space of the first array. In each of the above embodiments, rows or columns of the first and second arrays may be interleaved so that both arrays may be positioned on a smaller portion of the reflector of the antenna.

In some embodiments, all or substantially all of an entire multi-column array of radiating elements may be positioned in one of the column-shaped or row-shaped open spaces of another array.

Embodiments of the present invention will now be discussed in greater detail with reference to FIGS. 2A-13.

With the introduction of fifth generation or "5G" cellular service, new frequency bands have become available for cellular communications systems. Offering cellular service in these new frequency bands, while maintaining service in the legacy cellular frequency bands, may significantly expand the capacity of a cellular network.

Large numbers of stadium antennas 100 have been deployed that have the design of the stadium antenna of the '785 publication. However, with the deployment of 5G, many cellular operators would like to replace the stadium antennas 100 with higher capacity antennas that support service in the 5G frequency bands while also providing service in the legacy frequency bands. In particular, cellular operators would like to add two multi-column 5G antenna arrays to the conventional stadium antenna 100 that operate in some or all of the 3.3-3.8 GHz frequency range. This will allow the antenna to also support 4×MIMO service in the 3.3-3.8 GHz frequency range. Additionally, cellular operators would also like to replace the mid-band multi-column arrays 130, 140 of stadium antenna 100, which operate in the 1695-2170 MHz and 2300-2690 MHz frequency ranges, respectively, with a pair of multi-column antenna arrays that operate over the full 1695-2690 MHz mid-band frequency range. Such a modification provides more flexibility and allows the antenna to support 4×MIMO service, if desired, in any sub-band of the mid-band operating frequency range. The conventional stadium antenna 100 does not have room on the reflector 110 thereof for mounting two such mid-band arrays, as there is not room for ten columns of radiating elements that can support service at the lower end of the mid-band frequency range.

There is the potential for significant savings in installation costs if a new stadium antenna could be provided that supported both service in the legacy cellular frequency bands and in the new 5G frequency bands while being the same size as the stadium antenna 100, as this would make it easy to swap out the stadium antennas 100 for the new antennas while leaving existing mounting hardware in place.

Unfortunately, however, there is little unused room on the reflector 110 of the conventional stadium antenna 100 for one or more additional multi-column arrays of radiating elements. Moreover, it is difficult to shrink the sizes of the existing legacy antenna arrays 120, 130, 140 because (1) the size of the radiating elements is generally driven by the operating frequency range of the radiating elements and (2) the distances between the rows and columns of each array are selected based on performance considerations such as reducing grating lobes and/or coupling between radiating elements. Thus, shrinking the size of the multi-column arrays 120, 130, 140 sufficiently to make room for additional 5G antenna arrays is difficult, and likely would result in degradation of the performance of the legacy antenna arrays.

Figure 1B:
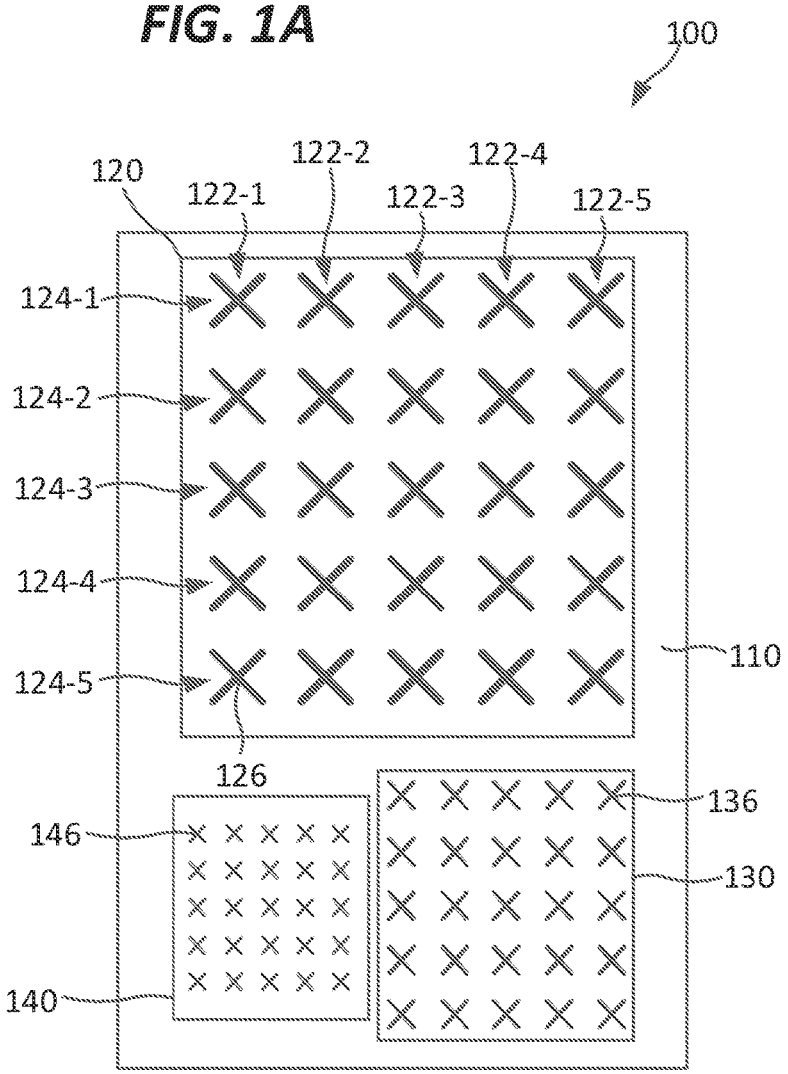
Figure 2A:
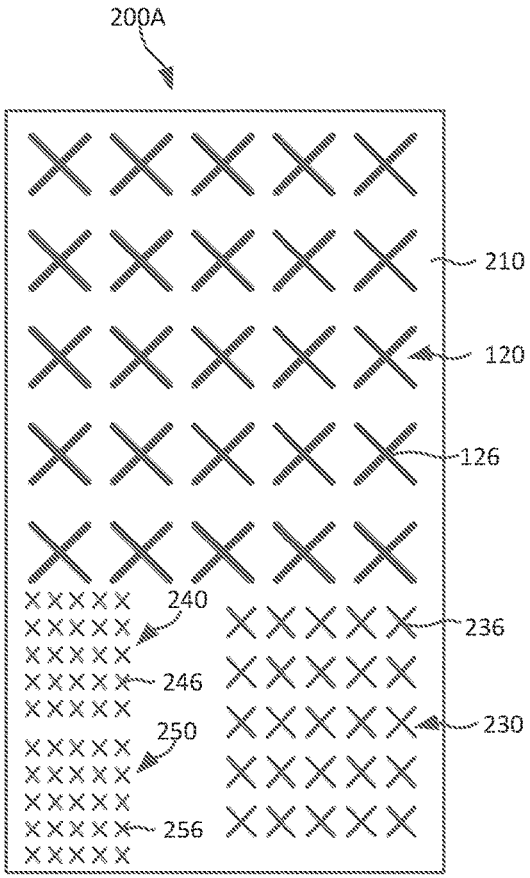
FIGS. 2A and 2B are schematic front views of base station antennas that can fit within the housing of the conventional stadium antenna of FIGS. 1A-1B that add 5G capabilities, but do so by omitting one or more of the antenna arrays included in the conventional stadium antenna.

FIG. 2A is a schematic front view of a base station antenna 200A that can fit within the same 1350 mm×850 mm housing as stadium antenna 100. The stadium antenna 200A includes four antenna arrays 120, 230, 240, 250. Antenna array 120 may be identical to the like-numbered antenna array of stadium antenna 100 of FIGS. 1A-1B, so further description thereof will be omitted. The center-to-center spacing between adjacent columns of low-band radiating elements 126 in array 120 may be about 165 mm.

Multi-column antenna array 230 is formed using twenty-five mid-band radiating elements 236 that are configured to operate in, for example, some or all of the 1695-2690 MHz frequency range. The radiating elements 236 may be dual-polarized radiating elements so that antenna array 230 can simultaneously generate two antenna beams at orthogonal polarizations to support 2×MIMO communications. The center-to-center spacing between adjacent columns of mid-band radiating elements 236 in array 230 may be about 80 mm. Multi-column antenna array 230 is similar to multi-column antenna array 130 of stadium antenna 100 of FIGS. 1A-1B, except that the radiating elements 236 of antenna array 230 are configured to operate over the entire mid-band frequency range as opposed to only operating over the lower portion of the mid-band frequency range as is the case with the radiating elements 136 in array 130 of stadium antenna 100.

Multi-column antenna array 240 is formed using twenty-five high-band radiating elements 246 that are configured to operate in, for example, some or all of the 3300-3800 MHz frequency range. The radiating elements 246 may be dual-polarized radiating elements so that antenna array 240 can simultaneously generate two antenna beams at orthogonal polarizations to support 2×MIMO communications. The center-to-center spacing between adjacent columns of high-band radiating elements 246 in array 240 may be about 42 mm. Multi-column antenna array 250 is formed using twenty-five high-band radiating elements 256 that are also configured to operate in, for example, some or all of the 3300-3800 MHz frequency range. The radiating elements 256 may be identical to radiating elements 246 so that the array 250 is identical to array 240. Hence, further description of array 250 will be omitted. It will be appreciated, however, that the two arrays 240, 250 may instead be different. For example, in other embodiments, high-band array 240 may include twenty-five high-band radiating elements 246 that are configured to operate in, for example, the 3300-3500 MHz frequency range, and high-band array 250 may include twenty-five high-band radiating elements 256 that are configured to operate in, for example, the 3500-3800 MHz frequency range.

Base station antenna 200A may fit within a housing that is 1350 mm tall by 850 mm wide, which is identical to the housing of the conventional stadium antenna 100 of FIGS. 1A-1B. Notably absent, however, from base station antenna 200A is antenna array 140 of stadium antenna 100, which is omitted to make room on the reflector 210 for antenna arrays 240, 250. Thus, while base station antenna 200A adds two additional high-band arrays and fits within the same housing as stadium antenna 100, one of the mid-band arrays of stadium antenna 100 is omitted in base station antenna 200A in order to make room for the two high-band arrays 240, 250.

Figure 2B:
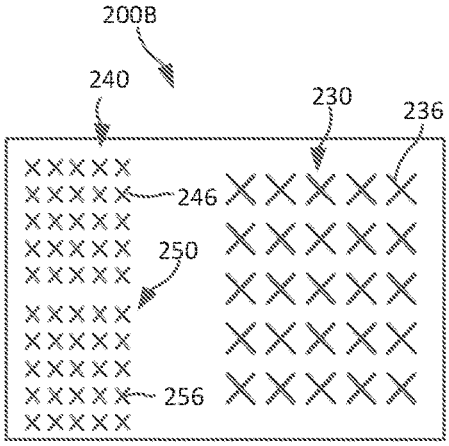

FIG. 2B is a schematic front view of a base station antenna 200B that also can fit within the same housing as stadium antenna 100 (or within a smaller housing). Base station antenna 200B includes three antenna arrays, namely antenna arrays 230, 240, 250. These arrays may be identical to the like-numbered arrays of base station antenna 200A that are discussed above, and hence further description thereof will be omitted. Base station antenna 200B may be much smaller than stadium antenna 100 and can, if desired fit in a housing having a height of about 600 mm and a width of about 400 mm. Base station antenna 200B, however, omits both the low-band antenna array 120 and one of the mid-band antenna arrays 130, 140 of stadium antenna 100, and hence again sacrifices capacity in the conventional cellular frequency bands in order to provide some 5G capabilities. Moreover, while it is possible to replace antenna array 230 with antenna arrays 130 and 140 of stadium antenna 100 and still fit within the same sized housing, this modified version of base station antenna 200B (which is not shown in the figures) still omits the low-band antenna array 120.

Figure 3A:
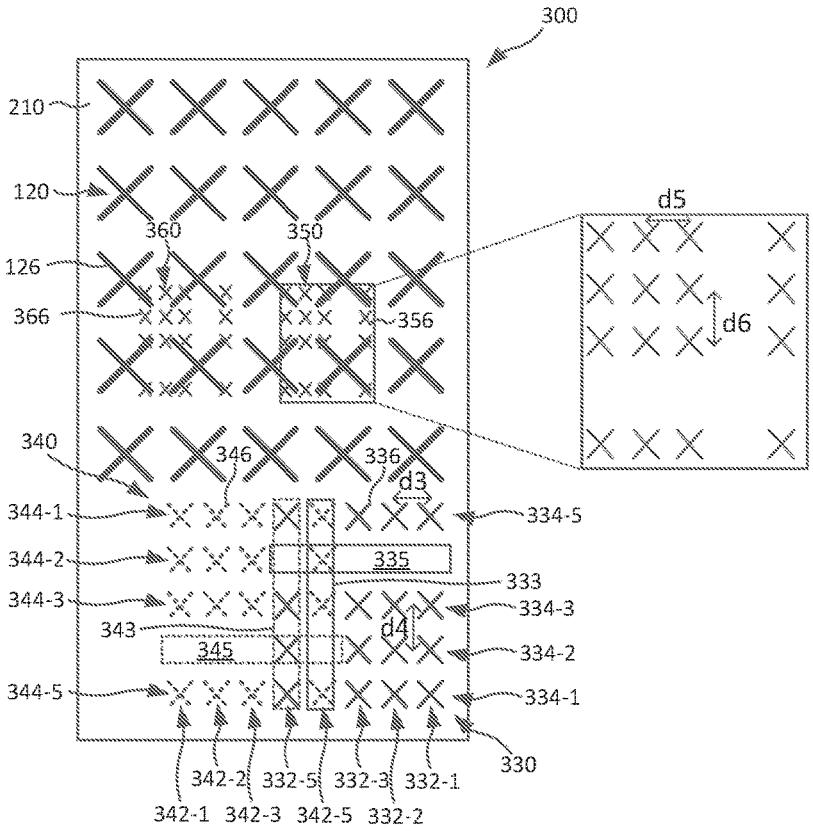
FIG. 3A is a schematic front view of a base station antenna according to embodiments of the present invention that can fit within the housing of the conventional stadium antenna of FIGS. 1A-1B while adding two 5G antenna arrays.

FIG. 3A is a schematic front view of a base station 300 according to embodiments of the present invention that can fit within the housing of the conventional stadium antenna 100 of FIGS. 1A-1B while adding two 5G antenna arrays.

As shown in FIG. 3A, the base station antenna 300 includes first through fifth multi-column antenna arrays 120, 330, 340, 350, 360. Each multi-column antenna array 120, 330, 340, 350, 360 includes radiating elements that are mounted to extend forwardly from a ground plane 210. The ground plane may, for example, be a sheet of metal that acts as a reflector and that provides a ground reference for the radiating elements in antenna arrays 120, 330, 340, 350, 360.

The first antenna array 120 may be identical to the like-numbered antenna array of stadium antenna 100, and has twenty-five low-band radiating elements 126 that are arranged in five columns 122-1 through 122-5 and five rows 124-1 through 124-5 (the numbering of the columns 122 and rows 124 are shown in FIG. 1A). Note that multi-part reference numerals may be used herein to designate multiple like elements. The low-band radiating elements 126 may, for example, be configured to operate in all or part of the 790-960 MHz frequency range. In other embodiments, low-band radiating elements (not shown) may be used that are configured to operate in all or part of the 696-960 MHz frequency range.

The five columns 122 and five rows 124 of antenna array 120 intersect at twenty-five locations, thereby defining twenty-five radiating element mounting locations. A low-band radiating element 126 is mounted in each of these mounting locations, as shown in FIG. 3A, and hence low-band antenna array 120 is fully populated with radiating elements 126. As will be described in greater detail below, the base station antennas according to embodiments of the present invention may include "sparse" antenna arrays which do not include radiating elements in all of the mounting locations. The use of such sparse arrays may reduce the cost of a base station antenna, and may also allow the radiating elements of two or more of the arrays to be interleaved, which may help reduce the size of the antenna.

Still referring to FIG. 3A, each of the remaining four antenna arrays 330, 340, 350, 360 included in antenna 300 have only sixteen radiating elements as opposed to the twenty-five radiating elements included in each of the arrays of conventional stadium antenna 100. Thus, arrays 330, 340, 350, 360 are implemented as sparse antenna arrays.

Still referring to FIG. 3A, the second array 330 is formed using sixteen mid-band radiating elements 336 that are configured to operate in some or all of the 1695-2690 MHz frequency range. The radiating elements 336 are dual-polarized radiating elements so that array 330 can simultaneously generate two antenna beams at orthogonal polarizations to support 2×MIMO communications.

Figure 3B:
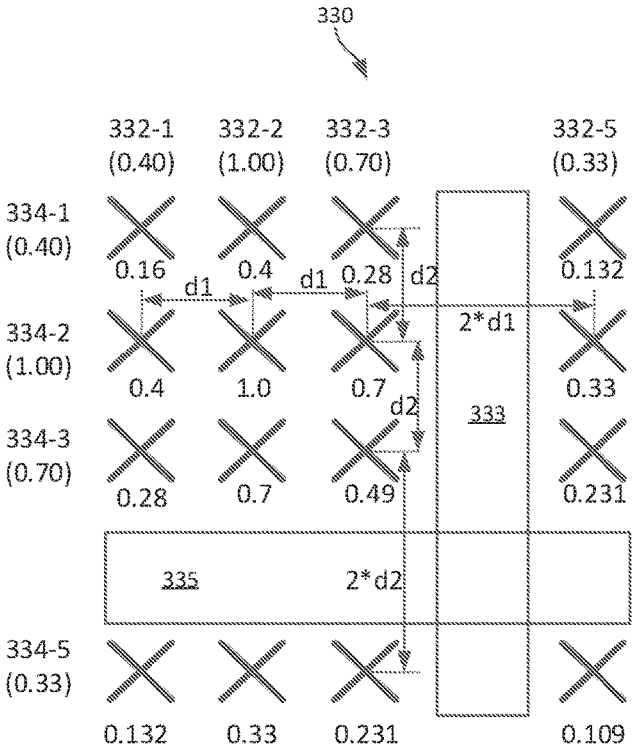
FIG. 3B is a schematic diagram illustrating the relative amplitudes of the sub-components of an RF signal that are fed to each radiating element of one of the arrays of the base station antenna of FIG. 3A.

FIG. 3B is an enlarged view of antenna array 330 of base station antenna 300 of FIG. 3A. As shown in FIG. 3B, the radiating elements 336 are arranged as if the antenna array 330 included five columns 332-1 through 332-5 of radiating elements 336 and five rows 334-1 through 334-5 of radiating elements 336. However, the radiating elements 336 that would have been included in the fourth column 332-4 and in the fourth row 334-4 are omitted. This creates a column-shaped open space 333 and a row-shaped open space 335 in the interior of array 330. The center-to-center spacing between columns 332-1 and 332-2 and between columns 332-2 and 332-3 may each be a first distance d1. The center-to-center spacing between columns 332-3 and 332-5 may be larger than the first distance d1. In some embodiments, the center-to-center spacing between columns 332-3 and 332-5 may be twice the first distance d1. The center-to-center spacing between rows 334-1 and 334-2 and between rows 334-2 and 334-3 may each be a second distance d2. The center-to-center spacing between rows 334-3 and 334-5 may be larger than the second distance d2. In some embodiments, the center-to-center spacing between rows 334-3 and 334-5 may be twice the second distance d2.

Operation of the sparse antenna array 330 will now be discussed with reference to FIGS. 1C, 3B and 3C.

Figure 1C:
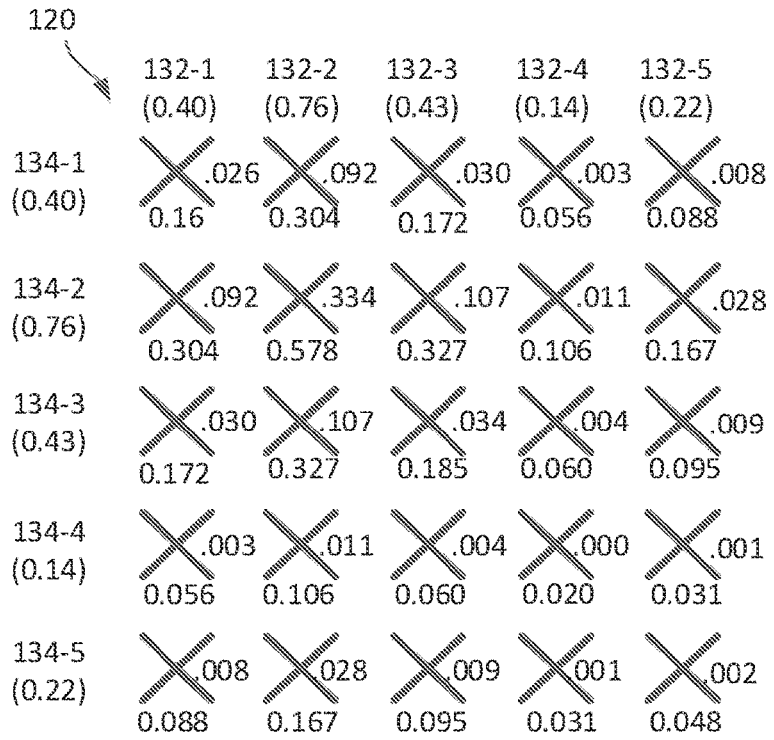
FIG. 1C is a schematic diagram illustrating the relative amplitudes of the sub-components of an RF signal that are fed to each radiating element of one of the arrays of the stadium antenna of FIGS. 1A-1B.

Referring to FIG. 1C, it can be seen that only a small amount of the total power of the RF signal (about 2%) is fed to the radiating elements 136 that form the fourth column of conventional antenna array 130 (FIG. 1C shows the power of the sub-component of the RF signal fed to each radiating element 136 to the right of the radiating element). Likewise, only a small amount of the total signal power (again, about 2%) is fed to the radiating elements 136 that form the fourth row of conventional array 130. Since the amount of power of an RF signal that is fed to the nine radiating elements 136 that are in either or both the fourth column 132-4 and the fourth row 134-4 of array 130 as compared to the amount of power fed to the other sixteen radiating elements 136 is small (about 4%), the radiating elements 136 in the fourth column 132-4 and the fourth row 134-4 may be omitted from the array 130 to form a mid-band array 330 without having a significant impact on the shape of the antenna beams generated by array 330. Omitting these radiating elements 136 (which reduce the number of radiating elements 136 in array 130 by nine so that array 330 only has sixteen radiating elements 136) may substantially reduce the cost for manufacturing the array 330. Moreover, by adjusting the relative amplitudes of the sub-components of the RF signal that are fed to the second, third and fifth columns 132-2, 132-3, 132-5 of radiating elements (as well as adjusting the phases), a substantially square-shaped antenna beam may be obtained. FIG. 3B is a schematic diagram illustrating modified amplitude values for the sub-components of the RF signal that are fed to each column (0.4, 1.0, 0.7, 0.0, 0.33) of array 330. The same amplitude distribution (0.4, 1.0, 0.7, 0.0, 0.33) is also used within each column (i.e., for the rows). The numbers underneath each radiating element 336 in FIG. 3B again show the amplitudes of the sub-components of the RF signal that are fed to the sixteen radiating elements in array 330.

Figure 3C:
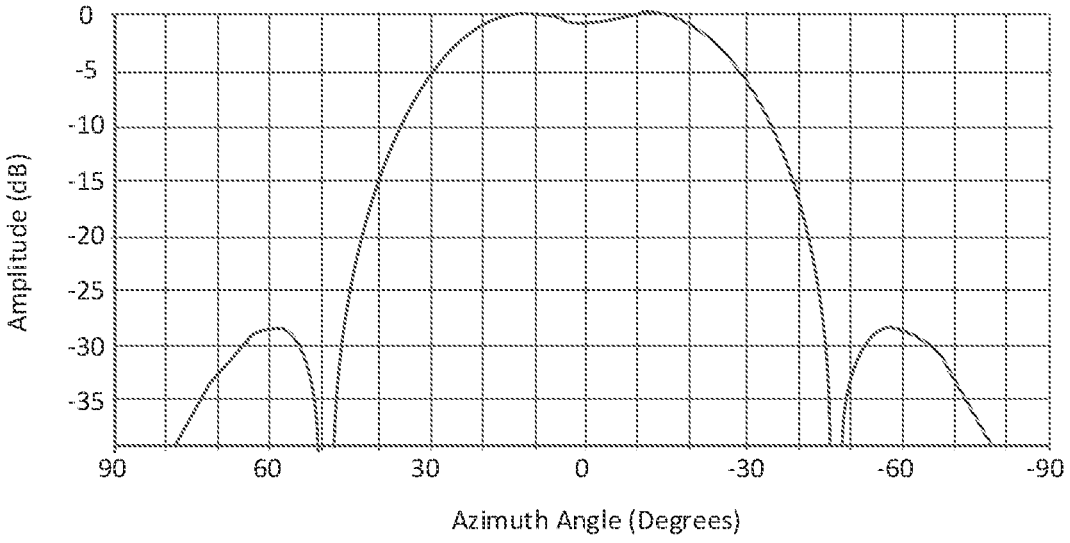
FIG. 3C is a graph illustrating the azimuth pattern (as well as the elevation pattern) of the antenna array of FIG. 3B.

FIG. 3C is a graph illustrating the azimuth pattern of the antenna beams formed by array 330. Since the array 330 is fed symmetrically in both the azimuth and elevation planes, the antenna pattern of FIG. 3C also represents the elevation pattern of the antenna beams formed by array 330. As can be seen from FIG. 3C, the resultant radiation pattern substantially resembles a square pulse, having a wide, flat half power beamwidth in the azimuth and elevation planes that has a very fast roll-off.

The omission of the radiating elements 336 in the mounting positions corresponding to the fourth column 332-4 and the fourth row 334-4 creates column-shaped and row-shaped open spaces 333, 335 on the reflector 210 that may be used to mount radiating elements of other arrays. This may allow fabrication of base station antennas that include antenna arrays that cover the same legacy frequency bands as the conventional stadium antenna 100 while also providing room for adding additional arrays that operate in new 5G frequency bands without increasing the size of the antenna.

The third array 340 is almost identical to the second array 330, and is formed using sixteen mid-band radiating elements 346 that are configured to operate in some or all of the 1695-2690 MHz frequency range. The radiating elements 346 are shown using dotted X-shapes in FIG. 3A so that it is easier to distinguish the radiating elements 346 from the radiating elements 336. The radiating elements 346 are dual-polarized radiating elements so that array 340 can simultaneously generate two antenna beams at orthogonal polarizations to support 2×MIMO communications. Arrays 330 and 340 may be used together to support 4×MIMO communications.

The radiating elements 346 are arranged as if the array 340 included five columns 342-1 through 342-5 and five rows 344-1 through 344-5 of radiating elements 346. However, the radiating elements 346 that would have been included in the fourth column 342-4 and in the fourth row 344-4 are omitted. This creates a column-shaped open space 343 and a row-shaped open space 345 within the interior of array 340. The center-to-center spacing between columns 342-1 and 342-2 and between columns 342-2 and 342-3 may each be a third distance d3. The center-to-center spacing between columns 342-3 and 342-5 may be larger than the third distance d3. In some embodiments, the center-to-center spacing between columns 342-3 and 342-5 may be twice the third distance d3. The center-to-center spacing between rows 344-1 and 344-2 and between rows 344-2 and 344-3 may each be a fourth distance d4. The center-to-center spacing between rows 344-3 and 344-5 may be larger than the fourth distance d4. In some embodiments, the center-to-center spacing between rows 344-3 and 344-5 may be twice the fourth distance d4.

The second and third arrays 330, 340 are oriented differently on the reflector 210. In particular, the radiating element 336 that is in the first column 332-1 and first row 334-1 of the array 330 is at the lower right-hand corner of array 330, while the radiating element 346 that is in the first column 342-1 and first row 344-1 of the array 340 is at the upper left-hand corner of array 340. Because of this difference in orientation, the fifth column 332-5 of array 330 may be positioned in the column-shaped open space 343 of array 340. Likewise, the fifth column 342-5 of array 340 may be positioned in the column-shaped open space 333 of array 330. Thus, because of the provision of the column-shaped open spaces 333, 343 the radiating elements 336, 346 of the second and third arrays 330, 340 may be interleaved, allowing the two arrays 330, 340 to fit within a smaller region of the reflector 210.

While interleaving the radiating elements of arrays 330, 340 reduces the amount of room required on the reflector 210 for these arrays, the interleaving also increases the coupling between the arrays, which can potentially degrade the performance of the arrays, particularly when the arrays are used to implement 4×MIMO communications. However, this risk is reduced in the particular implementation shown in FIG. 3A, as the two columns of the first array (e.g., array 330) that surround (on either side) a column of the second array (e.g., array 340) have relatively low power levels (the relative amplitude of the third column of the first array is 0.7 and the relative amplitudes of the fifth column of the first array and the fifth column of the second array are each 0.33). Thus, while increased coupling occurs, it tends to occur between columns having relatively lower power levels, and hence has a lesser impact on performance. Moreover, since the total number of columns of radiating elements required to implement arrays 330, 340 is reduced from ten to eight, there is extra room on the reflector. Some of this extra room may be used to slightly increase the distance between adjacent columns, which decreases the coupling between columns.

The fourth antenna array 350 is formed using sixteen high-band radiating elements 356 that are configured to operate in, for example, some or all of the 3300-3800 MHz frequency range. The radiating elements 356 are dual-polarized radiating elements so that array 350 can simultaneously generate two antenna beams at orthogonal polarizations to support 2×MIMO communications.

The radiating elements 356 of the fourth array 350 are arranged in the same fashion as the radiating elements 336, 346 of the second and third arrays 330, 340 so that array 350 has four columns of radiating elements 356 and a column-shaped open space 353, as well as four rows of radiating elements 356 and a row-shaped open space 355. The center-to-center spacing between adjacent ones of the first three columns may be a fifth distance d5, while the center-to-center spacing between the third column and the fifth column may be twice the fifth distance d5. The center-to-center spacing between adjacent ones of the first three rows may be a sixth distance d6, while the center-to-center spacing between the third row and the fifth row may be twice the sixth distance d6.

The high-band radiating elements 356 are much smaller than the low-band radiating elements 126, and hence the entire array 350 may take up less room on the reflector 210 than a box formed by a mere four of the low-band radiating elements. Moreover, the feed stalks for at least some of the low-band radiating elements 126 may be positioned in the column-shaped open space 353 and/or in the row-shaped open space 355. Thus, it is possible to position the array 350 within the footprint of the low-band array 120.

The fifth array 360 is formed using sixteen high-band radiating elements 366 that are configured to operate in, for example, some or all of the 3300-3800 MHz frequency range. The radiating elements 366 are dual-polarized radiating elements so that array 360 can simultaneously generate two antenna beams at orthogonal polarizations to support 2×MIMO communications. The fifth array 360 may be identical to the fourth array 350, and hence further description thereof will be omitted. The fifth array 360 may be positioned beside the fourth array 350 within the footprint of the first array 120 or may be positioned elsewhere (including other locations within the footprint of the first array 120).

The base station antenna 300 may fit within a housing having a height of 1350 mm and a width of 850 mm. The base station antenna 300 includes three arrays that may operate in the same frequency bands as the three arrays 120, 130, 140 of conventional venue antenna 100, and also adds two high-band (5G) arrays, without increasing the size of the antenna. Thus, the antenna 300 may be used to replace the conventional stadium antenna 100 using the existing mounting hardware.

As shown in FIG. 3A, base station antenna 300 includes an antenna array 330 that has a plurality of columns 332 of radiating elements 336, where all of the columns 332 except for column 332-3 and 332-5 are spaced apart from adjacent columns 332 by a distance d3. Columns 332-3 and 332-5 are spaced apart from each other a different distance that is larger than distance d3 to define the column-shaped open space 333 within array 330. A column 342-5 of another array 340 is positioned in the column-shaped open space 333 within array 330. In this embodiment, the column-shaped open space 333 does not include any radiating elements 336 that are part of array 330. The column-shaped open space 333 is directly adjacent an exterior column 332-5 of array 330.

The radiating elements 336 of array 330 are also arranged in a plurality of rows 334. All of the rows 334 except for rows 334-3, and 334-5 are spaced apart from adjacent rows 334 by a distance d4. Rows 334-3 and 334-5 are spaced apart from each other by a different distance that is larger than distance d4 to define a row-shaped open space 335 within array 330. In this embodiment, the row-shaped open space 335 does not include any radiating elements 336 that are part of array 330. The row-shaped open space 333 is directly adjacent an exterior row 334-5 of array 330.

Arrays 330 and 340 are stacked side-by-side. A single column of radiating elements of array 340 is positioned in the column-shaped open space 333 within array 330. As such, radiating elements 346 of array 340 are positioned within a footprint of array 330. Arrays 330 and 340 may be configured to generate substantially rectangular radiation patterns when excited by radio frequency signals. Both arrays 330 and 340 may be sparse arrays that have a total of four columns and four rows of radiating elements each. All of the radiating elements in the columns of radiating elements of array 330 are configured to be coupled to a common radio.

Still referring to FIG. 3A, it can be seen that base station antenna 300 includes an array 330 that has a plurality of columns 332 of radiating elements 336 and an array 340 that includes a plurality of columns 342 of radiating elements 346. A first column 332-5 of radiating elements 336 of array 330 are within an interior of array 340, and a first column 342-5 of radiating elements 346 of array 340 are within an interior of array 330.

Figure 4:
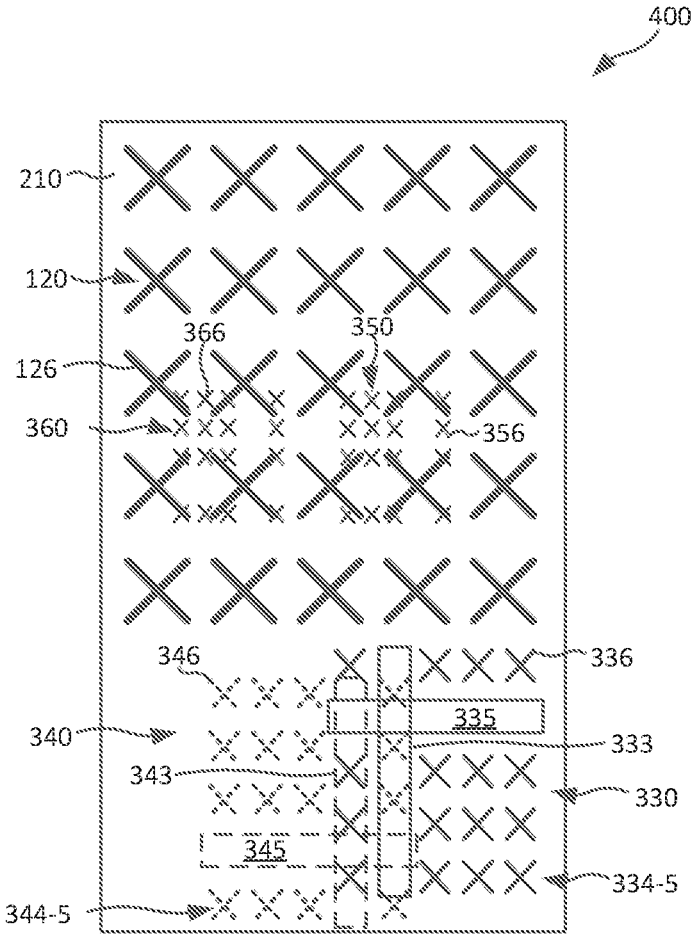
FIGS. 4-12 are schematic front views of base station antennas according to further embodiments of the present invention.

FIG. 4 is a schematic front view of a base station antenna 400 according to embodiments of the present invention. The base station antenna 400 is very similar to base station antenna 300, and includes the same five arrays 120, 330, 340, 350 and 360. Base station antenna 400 differs from base station antenna 300 in that the rows 344 of array 340 are no longer aligned with corresponding rows 334 of array 330, but instead are offset in the vertical direction. In some embodiments, the rows 344 of array 340 may be offset from the rows 334 of array 330 by a distance of about one half the distance d2 between adjacent ones of the closely-spaced rows of array 330. Offsetting the rows 334, 344 in this fashion may increase the isolation between arrays 330 and 340 as compared to the isolation between arrays 330, 340 achieved in base station antenna 300 of FIG. 3A. Base station antenna 400 may require a slightly larger length than base station antenna 300 due to the offsetting of the rows 334, 344 of arrays 330, 340. Many of the reference numbers are omitted from FIG. 4 (and subsequent figures) for elements that are identical to the above-described elements of FIG. 3A in order to simplify the drawing.

Figure 5:
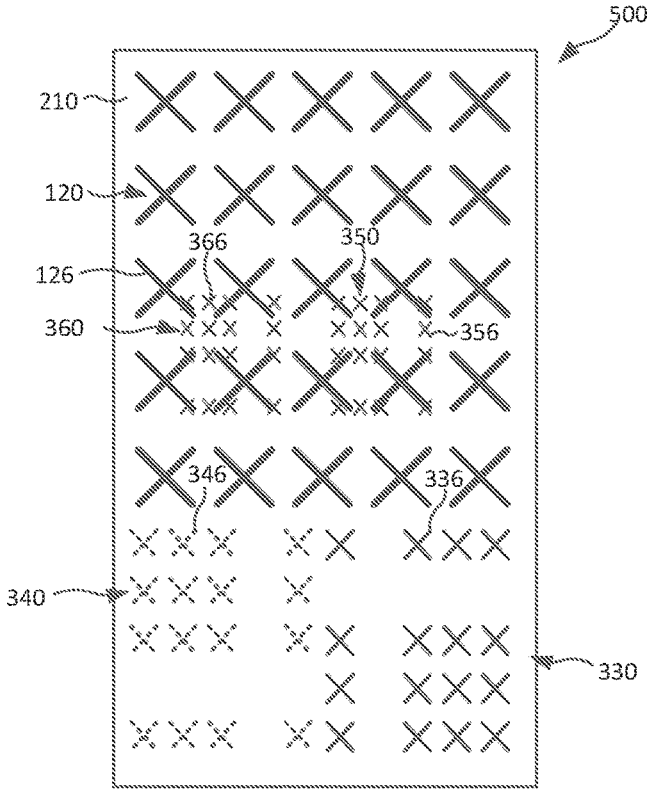

FIG. 5 is a schematic front view of a base station antenna 500 according to embodiments of the present invention. Base station antenna 500 is similar to base station antenna 300, and includes the same five arrays 120, 330, 340, 350 and 360. Base station antenna 500 differs from base station antenna 300 in that the columns 332, 342 of arrays 330, 340 are no longer interleaved, and instead the arrays 330, 340 are mounted next to each other in side-by-side fashion, in a manner similar to the arrays 130, 140 of conventional stadium antenna 100. In some embodiments, there may be enough room on the reflector 210 to mount the arrays 330, 340 in this fashion, and by not interleaving the arrays 330, 340, the isolation between the arrays 330, 340 may be improved. In an alternative embodiment, the rows of arrays 330, 340 in base station antenna 500 may additionally be offset in the same fashion discussed above with reference to venue antenna 400 of FIG. 4.

Figure 6:
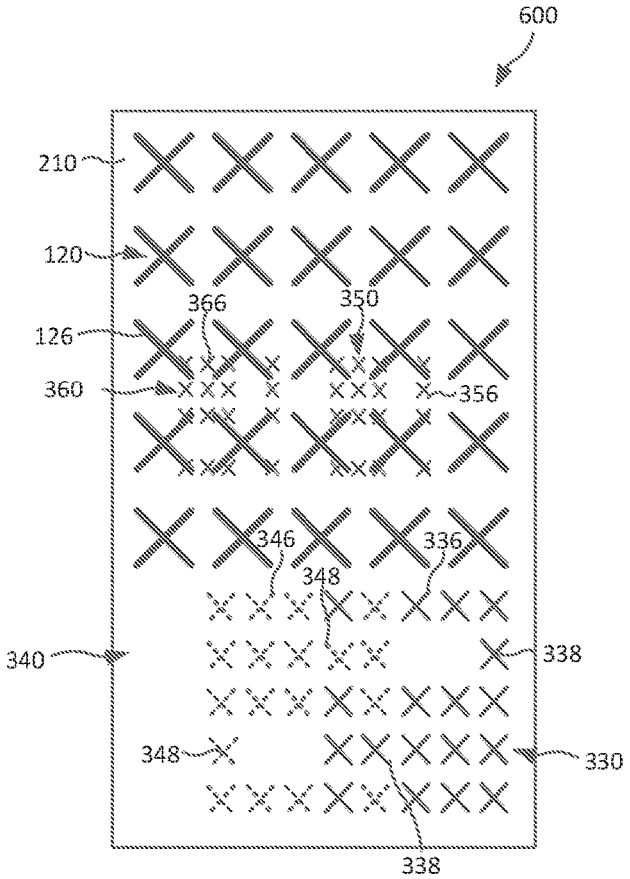

FIG. 6 is a schematic front view of a base station antenna 600 according to still further embodiments of the present invention. Base station antenna 600 is similar to base station antenna 300, but array 330 includes two additional radiating elements 338, and array 340 includes two additional radiating elements 348. The additional radiating elements 338, 348 may be identical to radiating elements 336, 346, respectively, but are given a different reference number to more clearly identify these additional radiating elements 338, 348 in FIG. 6. By including these additional radiating elements 338, 348 in the arrays 330, 340, the antenna beams formed by the arrays 330, 340 may be made slightly more square in shape. The additional radiating elements 338, 348 may be placed in any of the radiating element mounting locations within the respective arrays 330, 340 that are not occupied by radiating elements of the other array 330, 340. The amplitudes and/or phases of the sub-components of the RF signal that are fed to each radiating element 336, 346 may be adjusted to account for the inclusion of the additional radiating elements 338, 348 in the arrays 330, 340, respectively.

It will be appreciated that the number of additional radiating elements 338, 348 that are added to arrays 330, 340 may be varied. In other embodiments, only a single additional radiating element 338, 348 may be added to each array 330, 340, while in other embodiments more than two additional radiating elements 338, 348 may be added to each array 330, 340. It will likewise be appreciated that different numbers of additional radiating elements 338, 348 may be added to each array 330, 340, and/or that the additional radiating elements 338, 348 may be added at different radiating element mounting locations within the respective arrays 330, 340.

Figure 7:
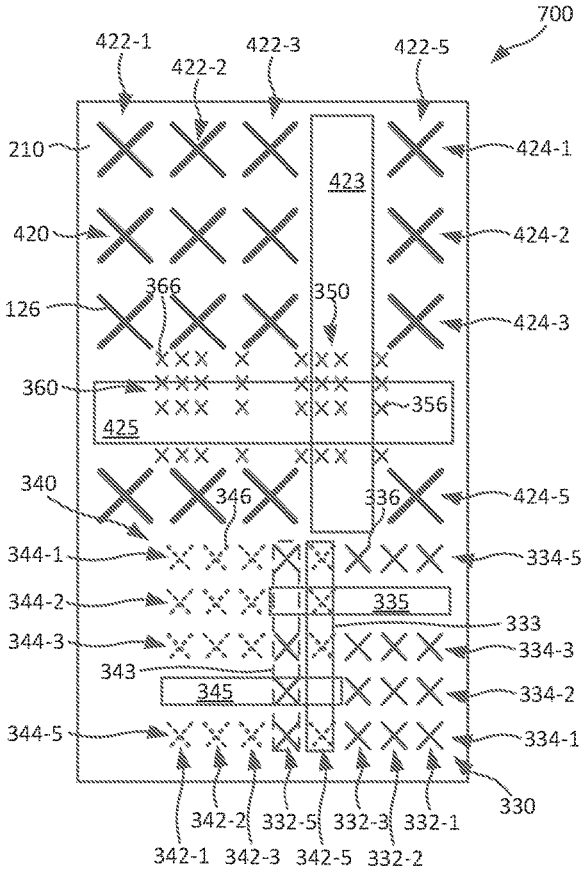

FIG. 7 is a schematic front view of another base station antenna 700 according to embodiments of the present invention that can fit within the housing of the conventional venue antenna of FIGS. 1A-1B while adding two 5G antenna arrays. Base station antenna 700 is similar to base station antenna 300, and four of the five arrays, namely arrays 330, 340, 350 and 360 are the same in both antennas 300, 700. Base station antenna 700 differs from base station antenna 300 in that the low-band array 120 of base station antenna 300 is replaced in base station antenna 700 with low-band array 420. Low-band array 420 has the same design as mid-band arrays 330, 340 and as high-band arrays 350, 360, in that the radiating elements 126 that were in the fourth column 122-4 and in the fourth row 124-4 of low-band array 120 are removed to form low-band array 420. Thus, low-band array 420 only includes a total of sixteen radiating elements 126 that are arranged in four columns 422-1 through 422-3 and 422-5 and four rows 424-1 through 424-3 and 424-5.

Similar to arrays 330, 340, 350 and 360 that are discussed above, low-band array 420 includes a column-shaped open space 423 and a row-shaped open space 425 where no radiating elements 126 are mounted. The column-shaped open space 423 corresponds to the positions of the low-band radiating elements 126 in column 122-4 of low-band array 120 (which are omitted in low-band array 420), and the row-shaped open space 425 corresponds to the positions of the low-band radiating elements 126 in row 124-4 of low-band array 120 (which are also omitted in low-band array 420). As is further shown in FIG. 7, the positions of the high-band arrays 350, 360 are changed in base station antenna 700 so that each high-band array 350, 360 is positioned in either or both the column-shaped open space 423 and/or the row-shaped open space 425. This may reduce any interaction between the low-band array 420 and the high-band arrays 350, 360, and may also provide additional room for mounting the radiating elements 356, 366 of the high-band arrays 350, 360.

Figure 8:
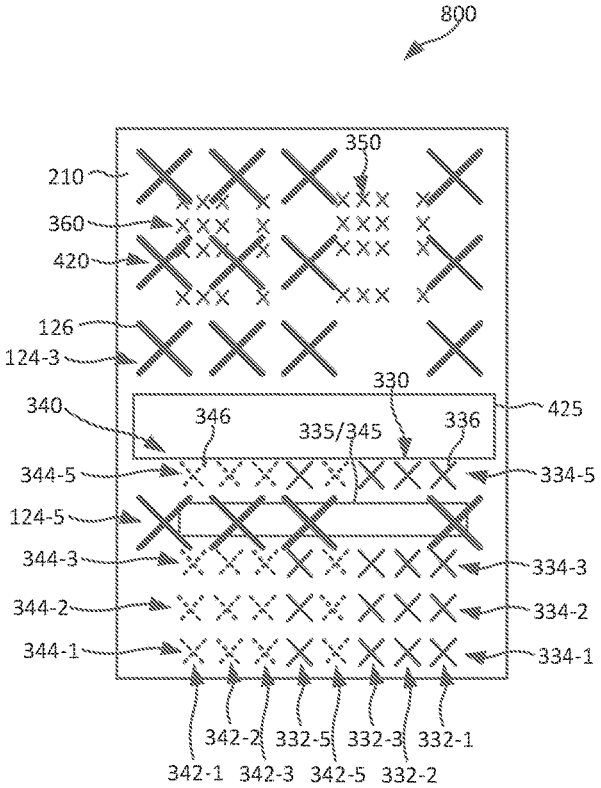

FIG. 8 is a schematic front view of another base station antenna 800 according to further embodiments of the present invention that is a modified version of the base station antenna 700 of FIG. 7. As can be seen, base station antenna 800 differs from base station antenna 700 in several ways. First, mid-band array 340 is rotated 180 degrees so that row 344-1 is the bottom row of the array and row 344-5 is the top row. As a result of this change, the row-shaped open spaces 335, 345 of arrays 330, 340 are horizontally aligned to create one larger row-shaped open space 335/345. Second, the high-band arrays 330, 340 are moved upwardly on the reflector so that the larger row-shaped open space 335/345 overlaps row 424-5 of low-band array 420. The provision of the larger row-shaped open space 335/345 allows the low-band array 420 to be interleaved with the two mid-band arrays 330, 340 while providing mounting locations on the reflector 210 for the radiating elements 126, 336, 346 of all three arrays 420, 330, 340. Likewise, row 334-5 of radiating elements 336 of array 330 and row 344-5 of radiating elements 346 of array 340 are mounted within a row-shaped open space 425 of array 420. Third, since the arrays 330, 340 are moved upwardly, the overall length of the base station antenna 800 may be reduced as compared to base station antenna 700. Fourth, the high-band arrays 350, 360 are moved upwardly on the reflector 210 to increase the distance between the high-band arrays 350, 360 and the mid-band arrays 330, 340 in order to increase the isolation therebetween. As all other aspects of base station antenna 800 have been discussed above with reference to base station antenna 700, further description thereof will be omitted.

Base station antenna 800 thus includes an array 330 that includes a plurality of rows 334 of radiating elements 336, an array 340 that includes a plurality of rows 444 of radiating elements 346, and an array 420 that includes a plurality of rows 424 of radiating elements 126. An exterior row 424-5 of array 420 is spaced apart from an adjacent row 424-3 of array 420 by a greater distance than the spacing between any of the other adjacent rows 424 in array 420 to define a row-shaped open space 425 within array 420. Row 334-5 of array 330 is positioned within the row-shaped open space 425 within array 420. Likewise, row 344-5 of array 340 is positioned within the row-shaped open space 425 within array 420. Rows 334-5 and 344-5 may be aligned with each other.

Figure 9:
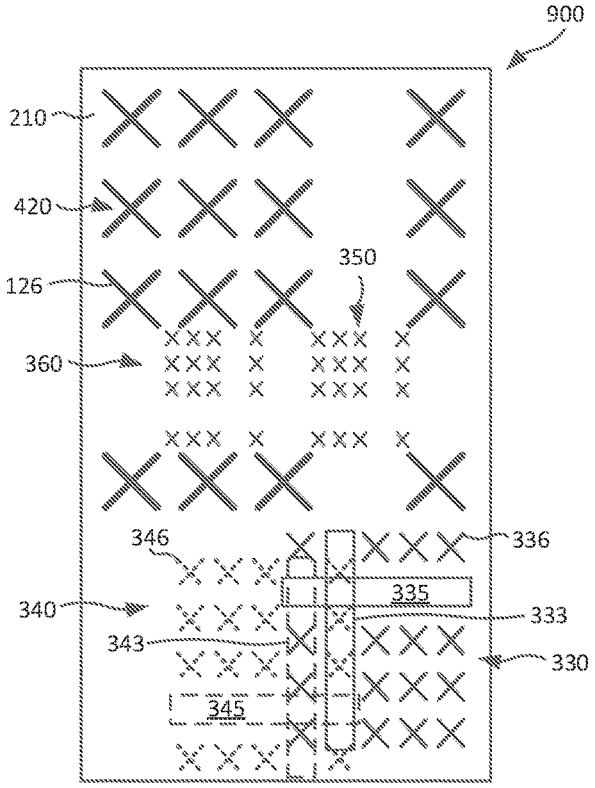

FIG. 9 is a schematic front view of another base station antenna 900 according to still further embodiments of the present invention. Base station antenna 900 combines aspects of base station antennas 700 and 400. In particular, in base station antenna 900 the rows 344 of radiating elements 346 of mid-band array 340 are shifted downwardly by, for example, about half the distance between the rows 344 in order to increase the isolation between mid-band array 330 and mid-band array 340.

Figure 10:
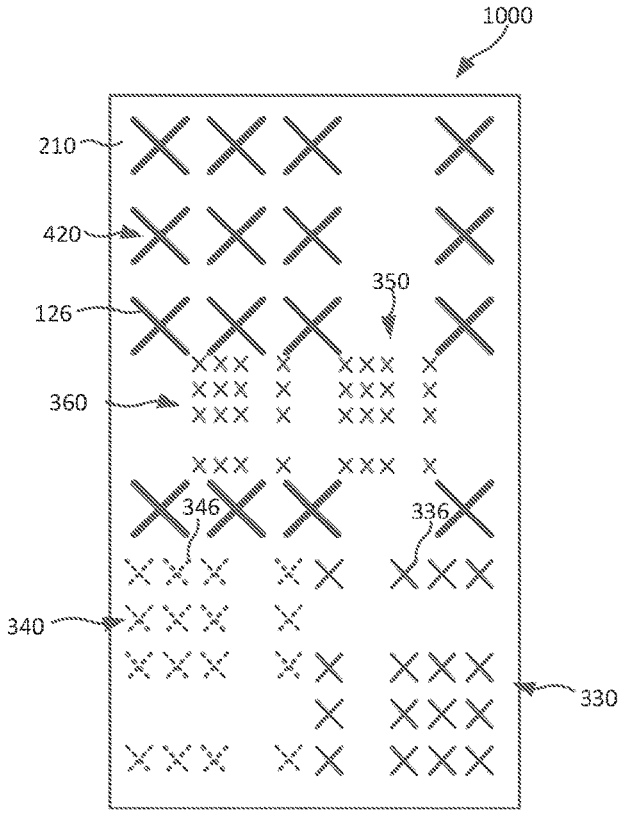

FIG. 10 is a schematic front view of a base station antenna 1000 according to yet additional embodiments of the present invention. Base station antenna 1000 combines aspects of base station antennas 700 and 500. In particular, base station antenna 1000 differs from base station antennas 700 in that columns 332, 342 of the arrays 330, 340 are no longer interleaved, and instead the arrays 330, 340 are mounted next to each other in side-by-side fashion, as was done in base station antenna 500. By not interleaving the arrays 330, 340, the isolation between the arrays 330, 340 may be improved. In an alternative embodiment, the rows of arrays 330, 340 in base station antenna 1000 may be offset in the same fashion discussed above with reference to venue antenna 400 of FIG. 4

Figure 11:
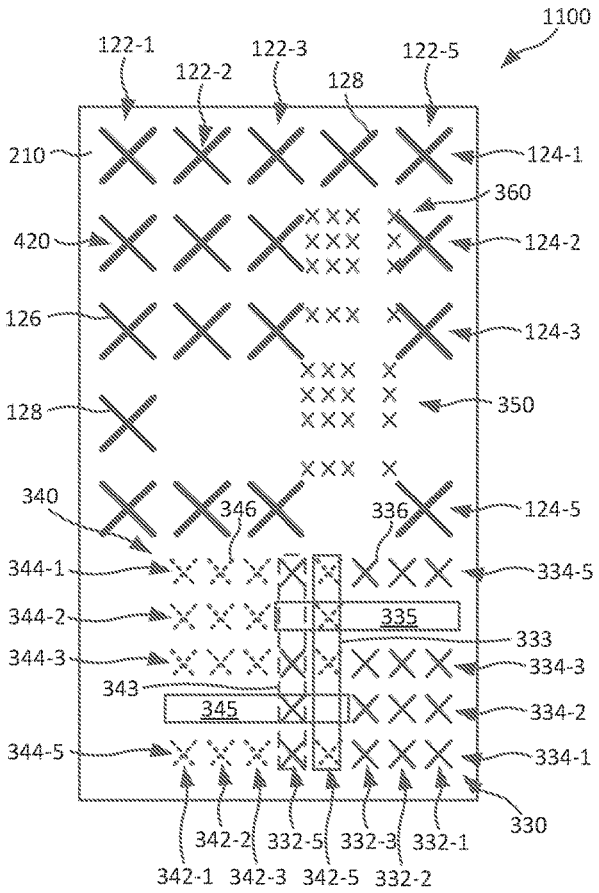

FIG. 11 is a schematic front view of a base station antenna 1100 according to additional embodiments of the present invention. The base station antenna 1100 is identical to base station antenna 700 except that the low-band array 420 of base station antenna 1100 includes two additional radiating elements 128. The additional radiating elements 128 may be identical to radiating elements 126. By including these additional radiating elements 128 in array 420, the shape of the antenna beams formed by array 420 may be improved (e.g., made more square). The additional radiating elements 128 may be placed in any of the radiating element positions within array 420. The amplitudes of the sub-components of the RF signal that are fed to each radiating element 126 may be adjusted to account for the inclusion of the additional radiating elements 128 in array 420.

Figure 12:
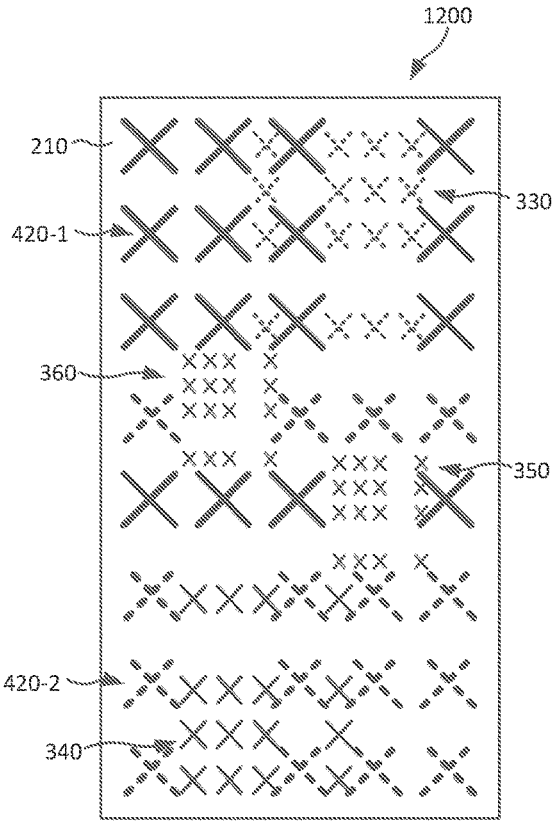

FIG. 12 is a schematic front view of a base station according to still further embodiments of the present invention. FIG. 12 illustrates how two arrays may be interleaved by positioning a row of a first array within a row-shaped open space of a second array. As shown in FIG. 12, two sparse low-band arrays 420-1, 420-2 are included in base station antenna 1200. The two low-band arrays 420 are interleaved by positioning the fifth row of low-band array 420-2 in the row-shaped opening in low-band array 420-1, and by positioning the fifth row of low-band array 420-1 in the row-shaped opening in low-band array 420-2. The radiating elements 126 of low-band array 420-2 are illustrated using dotted X's in order to make it easier to distinguish between the radiating elements 126 of the two low-band arrays 420. As is further shown in FIG. 12, the mid-band arrays 330, 340 are not interleaved with each other, but instead are positioned in the column-shaped open spaces of the respective low-band arrays 420-1, 420-2. The high-band arrays 350, 360 are also not interleaved with each other, but instead are positioned in the remaining open spaces within the respective column-shaped open spaces of low-band arrays 420-1, 420-2. The base station antenna 1200 is slightly longer than the other base station antennas discussed above, but adds an extra low-band array 420-2 in order to support 4×MIMO in the low-band frequency range.

The base station antennas according to embodiments of the present invention may have a plurality of RF ports. Radios may be connected to these RF ports via, for example, coaxial cables. The base station antennas may further include feed networks that pass RF signals between the antenna arrays and the RF ports. In embodiments where each antenna array is implemented using dual-polarized radiating elements, each array will have a pair of feed networks, namely a first feed network that connects a first polarization RF port to the radiating elements of the array, and a second feed network that connects a second polarization RF port to the radiating elements of the array. Each feed network sub-divides an RF signal received at the RF port of the feed network into a plurality of sub-components, and passes these sub-components to the respective radiating elements of the antenna array. The feed network may be configured to set the relative amplitudes and phases of these sub-components so that the array will generate a generally rectangular antenna beam in some embodiments.

Figure 13:
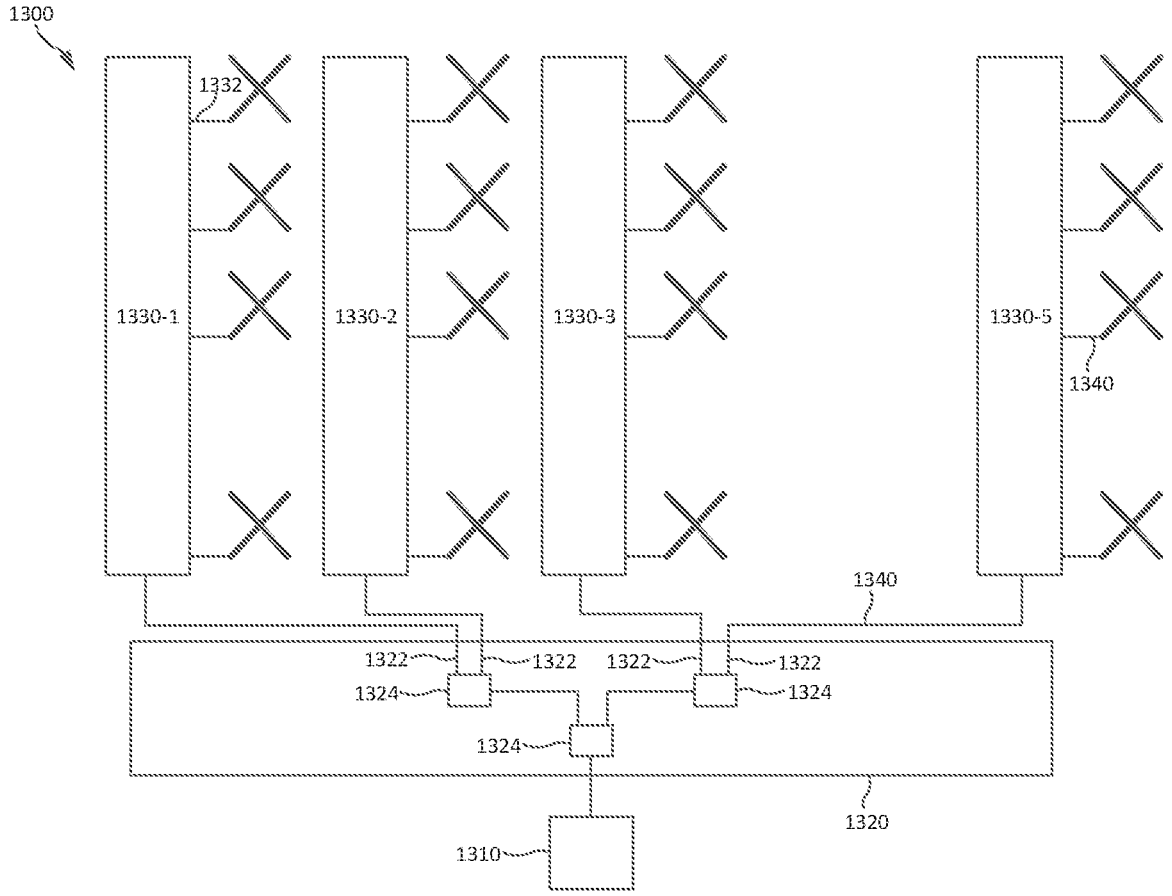
FIG. 13 is a schematic block diagram illustrating an example implementation of a feed network for one of the polarizations of one of the antenna arrays included in the base station antennas according to embodiments of the present invention.

The feed network may include power dividers that are used to split the RF signal into a plurality of lower power sub-components, as well as phase shifters (e.g., transmission line segments having different delays) that are used to adjust the phases of each sub-component of the RF signal to desired values. FIG. 13 illustrates an example implementation of a feed network 1300 for one of the polarizations of one of the antenna arrays included in the base station antennas according to embodiments of the present invention. As shown in FIG. 13, the feed network 1300 includes an RF port 1310, which may comprise, for example, an RF connector that has an end that is outside of a housing of the antenna (not shown). The RF port 1310 may be connected to an RF port of a radio (not shown). RF port 1310 is coupled to a "column" power divider 1320 that is within the base station antenna. The column power divider 1320 may comprise a 1×4 power divider that has four outputs 1322. As shown, the 1×4 power divider 1320 may be implemented, for example, using three 1×2 power dividers (e.g., Wilkinson power dividers) 1324. The four outputs 1322 of the column power divider 1320 may be used to feed the four columns of one of the sparse antenna arrays according to embodiments of the present invention. Each output 1322 is coupled to a respective one of four "row" power dividers 1330-1, 1330-2, 1330-3, 1330-5. Each row power divider 1330 may be identical to the above-described column power divider 1320. The four outputs 1332 of each row power divider 1330 are coupled to the four respective radiating elements that are included in each row of the sparse antenna arrays according to embodiments of the present invention. By setting the power splitting ratios on the power 1×2 dividers 1324 included in the 1×4 power dividers 1320, 1330, the radiating elements may be fed sub-components of an RF signal input to RF port 1310 that have, for example, the values shown in FIG. 3B. The phases of the sub-components of the RF signal that are fed to each radiating element by feed network 1300 may be adjusted to desired values by setting the relative lengths of the transmission lines 1340 in feed network 1300 to set the desired relative phase shifts.

In some cases, the base station antenna may include one or more multiplexers which can be used to split (in the transmit direction) and combine (in the receive direction) RF signals in different frequency bands. When such multiplexers are used (e.g., diplexers, triplexers, etc.), a single RF port may be connected to multiple feed networks, and the multiplexer is used to direct the RF signals to and from the appropriate feed network based on the frequencies of the RF signals. This may reduce the number of RF ports needed on the base station antenna.

As noted above, the base station antennas according to embodiments of the present invention may be particularly well-suited for use in stadiums and other large venues. The base station antennas may be placed on, or affixed to, ceilings or roofs of a stadium or other large venue so that the rectangular antenna beams formed by the antennas are directed downwardly to cover or "illuminate" a section of the stadium. Each section may, for example, correspond to one or more seating bays in the stadium, although embodiments of the present invention are not limited thereto. The edges of the rectangular antenna beams pattern have sharp cut-offs as shown in FIG. 3C, which reduces the interference between same-frequency antenna arrays of adjacent base station antennas within the venue. Providing base station antennas that generate rectangular antenna beams having sharp cut-offs also facilitates efficient sector planning within the venue.

In the example embodiments discussed above, each of the antenna arrays is configured as a "5×5" array that has mounting locations for a total of twenty-five radiating element positions that are arranged in five rows and five columns. Some of the radiating elements (e.g., nine of the radiating elements) are omitted in some of the antenna arrays in order to more efficiently mount the arrays on the reflector. It will be appreciated, however, that the antenna arrays may include more or fewer than twenty-five radiating element mounting locations. For example, some or all of the antenna arrays may include sixteen radiating element mounting locations that are arranged in a 4×4 array or thirty-six radiating element positions that are arranged in a 6×6 array (and these arrays may or may not omit radiating elements from some positions in the manner discussed above). It will also be appreciated that the arrays may be configured to generate antenna beams that have a generally rectangular shape that is not a square shape. Such antenna arrays may have different numbers of rows and columns of radiating elements.

Any appropriate radiating elements may be used to implement the radiating elements included in the antenna arrays of the base station antennas according to embodiments of the present invention. In example embodiments, the radiating elements may be implemented as cross-dipole radiating elements or as patch radiating elements, although embodiments of the present invention are not limited thereto. Suitable low-band and mid-band radiating elements are disclosed, for example, in PCT Publication No. WO 2017/165512 A1, the entire content of which is incorporated herein by reference. Suitable high-band radiating elements are disclosed in U.S. Pat. No. 10,587,034, the entire content of which is incorporated herein by reference.

The above-description refers to the arrays having columns and rows. It will be appreciated whether a line of radiating elements is considered to be a column or a row depends on the orientation of the antenna. Thus, a column may become a row and a row may become a column by changing the orientation of the antenna. Thus, the terms column and row are used to distinguish between perpendicularly-oriented lines of radiating elements within an array, but the lines of radiating elements may be considered to be either rows or columns.

The present invention has been described above with reference to the accompanying drawings. The invention is not limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity.

Spatially relative terms, such as "under", "below", "lower", "over", "upper", "top", "bottom" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Herein, the terms "attached", "connected", "interconnected", "contacting", "mounted" and the like can mean either direct or indirect attachment or contact between elements, unless stated otherwise.

Well-known functions or constructions may not be described in detail for brevity and/or clarity. As used herein the expression "and/or" includes any and all combinations of one or more of the associated listed items.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" when used in this specification, specify the presence of stated features, operations, elements, and/or components, but do not preclude the presence or addition of one or more other features, operations, elements, components, and/or groups thereof.

That which is claimed is:

1. A base station antenna, comprising:

a first array that includes a plurality of columns of radiating elements, where all of the columns in the first array except for a first column and a second column are spaced apart from adjacent of the columns of the first array by a first distance, the first and second columns of the first array being spaced apart from each other by a different distance that is larger than the first distance to define a first column-shaped open space within the first array.

2. The base station antenna of claim 1, wherein the first column-shaped open space does not include any radiating elements that are part of the first array, and the different distance is about twice the first distance.

3. The base station antenna of claim 1, wherein the first column-shaped open space includes a total of one radiating element that is part of the first array.

4. The base station antenna of claim 1, wherein the first column-shaped open space is directly adjacent an exterior one of the plurality of columns.

5. The base station antenna of claim 1, wherein the radiating elements are also arranged in a plurality of rows, and where all of the rows of the first array except for a first row and a second row of the first array are spaced apart from adjacent of the rows of the first array by a second distance, the first and second rows of the first array being spaced apart from each other by twice the second distance to define a first row-shaped open space within the first array.

6. The base station antenna of claim 1, further comprising a second array that includes a plurality of columns of radiating elements, wherein all of the columns in the second array except for a first column and a second column of the second array are spaced apart from adjacent of the columns of the second array by a third distance, the first and second columns of the second array being spaced apart from each other by twice the third distance to define a second column-shaped open space within the second array.

7. The base station antenna of claim 6, wherein the radiating elements of the second array are also arranged in a plurality of rows, and where all of the rows of the second array except for a first row and a second row of the second array are spaced apart from adjacent of the rows of the second array by a fourth distance, the first and second rows of the second array being spaced apart from each other by twice the fourth distance to define a second row-shaped open space within the second array.

8. The base station antenna of claim 6, wherein multiple columns of radiating elements of the second array are positioned in the column-shaped open space within the first array.

9. The base station antenna of claim 6, wherein the first array and the second array are stacked side-by-side, and wherein radiating elements of the second array are within a footprint of the first array.

10. The base station antenna of claim 1, wherein the first array is configured to generate a substantially rectangular radiation pattern when excited by a radio frequency signal.

11. A base station antenna, comprising:

a first array that includes a plurality of columns of radiating elements; and a second array that includes a plurality of columns of radiating elements, wherein a first column of radiating elements of the first array are within an interior of the second array, and a first column of radiating elements of the second array are within an interior of the first array.

12. The base station antenna of claim 11, wherein the first column of radiating elements of the first array are directly adjacent an exterior column of radiating elements of the second array.

13. The base station antenna of claim 11, wherein the radiating elements of the first array are arranged in a plurality of rows, and wherein all of the rows in the array except for a first row and a second row of the first array are spaced apart from adjacent of the rows of the first array by a second distance, the first and second rows of the first array being spaced apart from each other by twice the second distance to define a first row-shaped open space within the first array.

14. The base station antenna of claim 11, wherein both the first array and the second array configured to generate substantially rectangular radiation patterns when excited by radio frequency signals.

15. The base station antenna of claim 14, wherein the first array has a total of four columns and four rows of radiating elements and the second array has a total of four columns and four rows of radiating elements.

16. A base station antenna, comprising:

a first array that includes a plurality of rows of radiating elements;

a second array that includes a plurality of rows of radiating elements; and a third array that includes a plurality of rows of radiating elements, where a first exterior row of the third array is spaced apart from an adjacent row of the third array by a greater distance than the spacing between any of the other adjacent rows in the third array to define a third row-shaped open space within the third array, and wherein a first row of the first array is positioned within the third row-shaped open space within the third array.

17. The base station antenna of claim 16, wherein a second row of the second array is also positioned within the third row-shaped open space within the third array.

18. The base station antenna of claim 17, wherein the first row of the first array is aligned with the second row of the second array.

19. The base station antenna of claim 16, wherein all of the radiating elements in the third array are coupled to a common radio frequency port of the base station antenna.

20. The base station antenna of claim 16, wherein the first array, the second array and the third array are each configured to generate substantially rectangular radiation patterns when excited by radio frequency signals.

* * * * *